United States Patent [19]

Praml

[11] 4,019,797

[45] Apr. 26, 1977

[54] SYSTEM INCLUDING HOUSEHOLD CONNECTOR PLUG FOR SPLIT WIRE RECEPTACLE

[76] Inventor: Henry W. Praml, 275 South St., Murray Hill, N.J. 07974

[22] Filed: Nov. 17, 1975

[21] Appl. No.: 632,447

[52] U.S. Cl. ..... 339/14 P

[51] Int. Cl.[2] ..... H01R 3/06

[58] Field of Search ..... 339/14 R, 14 L, 14 P

[56] References Cited

UNITED STATES PATENTS

| | | | |
|---|---|---|---|
| 3,784,953 | 1/1974 | Lingaraju | 339/14 R |
| 3,861,773 | 1/1975 | Triantafellow et al. | 339/103 R |

*Primary Examiner*—Roy Lake

*Assistant Examiner*—DeWalden W. Jones

*Attorney, Agent, or Firm*—Martha G. Pugh

[57] ABSTRACT

This relates to an electrical connecting device or plug, preferably of the U-grounded type, which when plugged into a standard split wire duplex receptacle will double the voltage potential available at the receptacle. A modified form of the invention comprises an electrical connecting device or plug which when plugged into a standard split wire duplex receptacle will provide an option of either doubling the voltage potential available at the receptacle or, alternatively, operating as a single plug for a pair of appliances, each at normal household voltage.

10 Claims, 9 Drawing Figures

SYSTEM INCLUDING HOUSEHOLD CONNECTOR PLUG FOR SPLIT WIRE RECEPTACLE

BACKGROUND OF THE INVENTION

This invention relates in general to electrical connecting devices, particularly of the U-grounded type, adapted for connection to a standard split wire duplex receptacle.

The need for this invention arises from the requirement of many common household appliances for a potential of up to 250 volts, whereas the line or house current which is available in the normal receptacles used in most American homes is limited to about 125 volts. In order to make the outlets more flexible, so that they can accommodate either appliances requiring up to 125 volts or up to 250 volts, special wiring would be required, at additional expense to the householder.

While prior art contains teaching pertaining to a number of types of connectors, adapters and circuit arrangements which are capable of altering line or house voltages in various ways, none of these devices is constructed to cooperate with the standard split wire duplex receptacle without substantial alterations in the house wiring.

SUMMARY OF THE INVENTION

Accordingly, the principal object of the present invention is to provide a convenient and inexpensive method and apparatus for adapting the standard split wire duplex receptacle to receive appliances requiring voltages which are double those ordinarily available in most residential circuits. Another object of the present invention is to increase the flexibility of standard house wiring to accommodate to appliances having different voltage requirements without the necessity for constant changes in the wiring.

These and other objects are realized in accordance with the present invention which relates to an electrical plug or connector of the U-grounded type comprising a hollow boxlike insulative housing portion from which project ground contact prongs and power blades which are designed to be received by a split wire duplex receptacle (usually having a potential not exceeding 125 volts across each half). The receptacle is conventional except for the fact that the connecting clip is broken so that the two halves are insulated from each other.

In accordance with one embodiment of the invention, a plug or connector is constructed to include two power blades and two ground prongs, so disposed that when it is plugged into the receptacle, the power blades simultaneously contact the two high potential or "hot" wires of the split wire connector, thereby functioning to provide double the oridinary house voltage available across each half of the duplex receptacle.

A second embodiment of the invention comprises a plug or connector including, in addition to the two high potential power blades and two ground prongs, a pair of neutral blades. This serves, at the option of the user, either to provide double the house voltage to a single appliance, such as an air conditioner, or to furnish ordinary house voltage, simultaneously, to a pair of separate appliances, such as, for example, a primary motor and a back-up motor for a hospital respirator.

Plugs or connectors in accordance with the present invention provide flexibility in ordinary household electrical systems which enables them to readily accommodate appliances, such as air conditioners, requiring voltages higher than those usually provided to residences, without extensive rewiring, which may be both expensive and time consuming.

These and other objects, features and advantages of the invention will be apparent to those skilled in the art upon a study of the specification hereinafter with reference to the attached drawings.

DETAILED DESCRIPTION

In accordance with the broad principles of this invention, a plug or connector is provided comprising an insulative housing in which a plurality of conductive members are disposed to enable the connection of an appliance or other load-bearing source across the two high potential female contacts of a split wire duplex receptacle or any two power sources which alternate at the same frequency, but 180° out-of-phase or, alternatively, between two direct current power sources of substantially equal and opposite potential. When a connector in accordance with the present invention is plugged into a standard 110-volt split wire duplex receptacle, it is designed to develop a potential of between about 220 and 250 volts across its two male power blades which engage the high potential contacts of said receptacle. The plugs and receptacles described herein are designed in accordance with the requirements of Underwriters' Laboratories, Inc., to operate at currents up to about 20 amperes.

Figure 1:
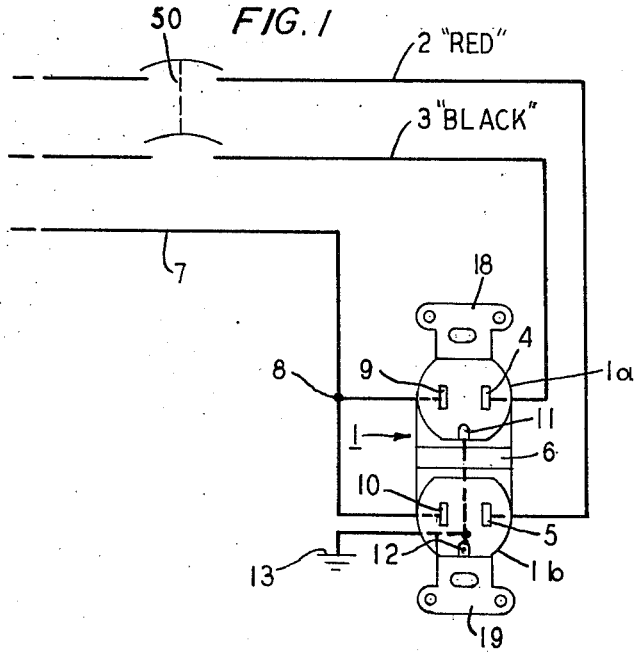
FIG. 1 is a schematic showing of a split wire circuit of a type often used in residences for connection to duplex wall outlets or receptacles.

Referring to the drawings, in FIG. 1 one sees a schematic showing of a split wire circuit of a type conventionally available in many present day residences. This shows a U-grounded duplex electrical receptacle 1 comprising a pair of outlets 1*a*, 1*b*, which is conventional in every respect except that the connecting clip that usually connects the two high potential or hot wire input leads in parallel has been broken, electrically isolating the two outlets of the receptacle from one another. Each of the two high potential or hot wires 2 and 3, which for the purposes of the present discussion will be referred to as "red" and "black", respectively, are connected to the power panel through a single throw 220 -volt breaker 50. At their other ends, high potential or hot wires 2 and 3 are connected through mutually insulated circuits to the female receptacles 4 and 5 at opposite ends of the insulating housing 6, the body of which is formed of hard rubber or one of the rigid insulating plastic materials of a general phenolic type, conforming to the specifications of Underwriters' Laboratories, Inc. Female power receptacles 4 and 5 are aligned and respectively centered near one edge of each of the dual outlets 1*a* and 1*b* of the duplex outlet 1. The centers of receptacles 4 and 5 are respectively spaced apart one-half inch from the centers of corresponding neutral receptacles 9 and 10, each being of the standard size to accommodate conventional plug blades. The female receptacles 9 and 10, which are similarly of conventional dimensions, are in alignment along one of the long sides of the duplex outlet 1; and female receptacles 4 and 5 are aligned in parallel relation to 9 and 10 along the opposite long side. It will be noted that although the receptacles 4 and 9 in 1*a* and 5 and 10 in 1*b* are designed in the conventional manner, with the long edges of each pair of openings parallel, they can also be designed in an alternative manner, with the long edges rotated through 90° so that the short edges are parallel. The neutral conductor 7 goes to junction 8, which is connected in parallel to receptacles 9 and 10 on each end of the duplex outlet. The U-grounded receptacles 11 and 12, which are in alignment along the longitudinal centerline of the duplex receptacle, as shown in FIG. 2, are connected together to ground 13, which maybe true ground, or a connection to the metal building frame or pipe system.

Figure 2:
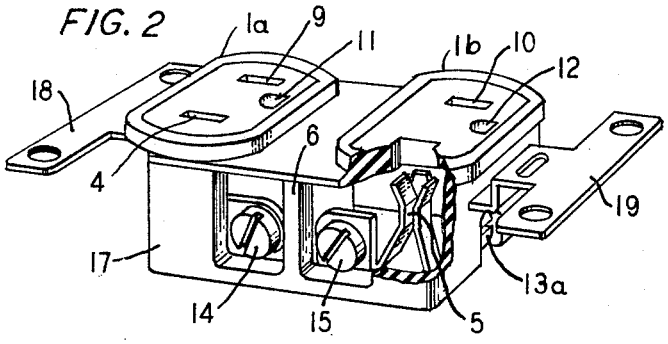
FIG. 2 is a showing in perspective of the duplex receptacle of FIG. 1, partially broken away to show details of the interior.

FIG. 2 is partially broken away to show the internal wiring of the receptacle 1. The screw contacts 14 and 15, fully insulated from one another, are respectively connected to the red and black positive or hot wires 2 and 3, whereas the screw contact 13*a*, connected to U-grounded receptacles 11 and 12, is available for the ground connection. The neutral receptacles 9 and 10 are strapped in parallel to a single external contact (not shown) at junction 8, to neutral lead wire 7.

FIGS. 3, 4 and 6, 7 show two forms of plugs or connectors which are designed to terminate the cords from one or more electrical appliances or other laod-bearing devices. Each of the plugs or connectors comprises an insulative housing 20 fabricated of hard rubber, plastic or other like nonconductive material. Preferably, this may comprise plastic of a phenolic type conforming to the specifications of Underwriters' Laboratories, Inc. In each of the present illustrative embodiments, the housing 20 comprises a rectangular body, 3 inches by 2 inches by 1 inch, molded or otherwise constructed to hold the electrically operative elements in rigid relation. Housing 20 can be provided with multiple parts secured together, such as the two-part construction shown in perspective in FIG. 4, or can simply be provided in unitary form by molding or encapsulation or the like. In both of the embodiments of the invention shown in FIGS. 3, 4 and 6, 7, the aforementioned contact prongs and power blades are supported in each case by various housing portions, projections or surfaces or total encapsulation of a type which is sufficient to hold the prongs or blades against unitary displacement. Suitable means well-known in the art are used to securely anchor all of the operative elements both within and external to the housing cavity.

Figure 3:
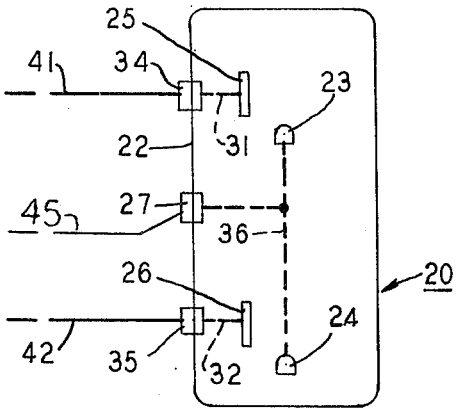
FIG. 3 is a plan view, partly in schematic, of a U-grounded plug or connector in accordance with one embodiment of the invention.
Figure 4:
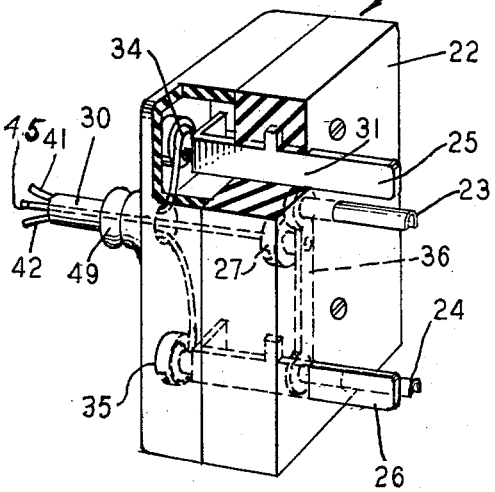
FIG. 4 is a perspective view of the plug or connector of FIG. 3 in which the housing has been partially broken away to reveal its interior construction.

With reference to FIGS. 3 and 4, there is shown, projecting from the front surface 22 of the housing 20, molded or otherwise rigidly anchored therein, a pair of flat, rectangular power blades 25 and 26. In the present embodiment these are copper, brass, or other highly conductive metal, each ¼ inch wide, 2/16 inch thick, and projecting outwardly roughly ½ inch from the face 22 of housing 20. Blades 25 and 26 are aligned edgewise in the same plane, which is normal to and off center on surface 22. In the present embodiment, blades 25 and 26 are disposed so that their edges are centered a distance of about ¼ inch to one side of the longitudinal centerline of face 22, the upper blade 25 being centered about 9/16 inch below the upper short edge, and the lower blade 26 being centered roughly 2 1/16 inches below the latter. In any case, the two blades have their centers spaced apart about 1½ inches, and are constructed so as to mate directly in secure relationship with the female contact pair 4 and 5 of the standard split wire duplex receptacle 1, which connects across the high potential or hot wires 2 and 3 as shown in FIG. 1. It will be understood that blades 25 and 26, in alternative form, can be disposed in a plane normal to that indicated in FIG. 4, with their broad faces parallel, in which case they would also be accommodated by an appropriate modification of the female contact pair 4 and 5, shown in FIG. 2. In addition, a pair of conventional U-grounded prongs 23 and 24 are provided which are disposed along the longitudinal central axis of the face 22 of housing 20. Prongs 23 and 24 are semicylindrical or U-shaped, formed of brass, copper or other conducting metal conventionally used for this purpose. Prong 23 is centered roughly one inch below the upper short edge of face 22; prong 24 is centered 7/16 inch above the opposite edge, so that the two prongs are roughly centered one and one-half inches apart, being disposed to engage and mate with the standard U-grounded female receptacles 11 and 12, indicated in FIGS. 1 and 2.

Both pairs of blades and prongs extend through front surface 22 and into the interior of the housing 20. Within the housing 20, the U-grounded prongs 23, 24 are joined by an electrically conductive member 36 to an external or internal ground contact 27. Alternatively, an insulated conductor electrically connected to and leading from conductor 36 extends across the interior of housing 20 and out through an insulating nipple 49 as metallic lead wire 45 which projects from the center of the rear surface (FIG. 4).

Within the interior of housing 20, conventional connecting means 31, 32, comprising inward extensions of the power blades 25, 26, are fastened in electrical contacting relation to terminals 34 and 35. In the embodiment shown in FIG. 4, these are connected in electrically isolated relation to conducting leads passing out through the insulating nipple 49 projecting from the rear surface of the housing 20. Upon emerging from nipple 49 these two conductors, together with metallic ground lead 45, are enclosed within an insulative conduit or cable 30 which comprises the cord leading to the electrical appliance or other load source. A circuit which requires a voltage potential double the ordinary line voltage may be formed by connecting an appliance or other load between lead wires 41, 42 across the terminals 34 and 35 between the two high potential power blades 25 and 26. The isolated power blades 25 and 26 and the interconnected ground conductors 23 and 24 may be color coded for ease of identificatin, red, identification, and green, respectively.

Figure 5:
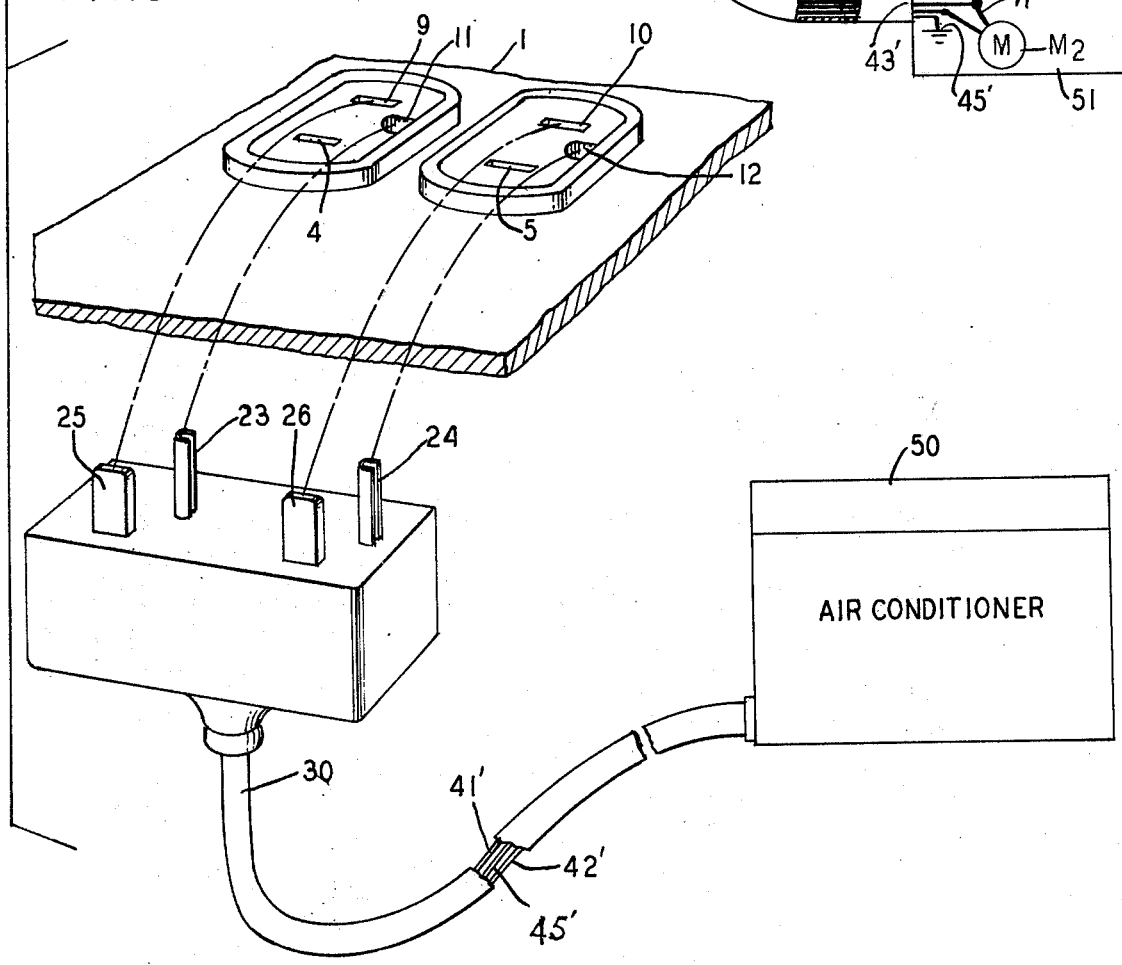
FIG. 5 is a perspective showing of a plug or connector in accordance with the embodiment of the present invention disclosed in FIGS. 3 and 4, in the process of being connected by between a receptacle and an appliance such as an air conditioner, requiring a potential not exceeding 250 volts.

FIG. 5 shows an air conditioner 50 in the process of being connected in mating relationship to slots 4 and 5 of a split wire duplex receptacle of the type indicated in FIG. 2. Air conditioner 50, which requires at least about a 220-volt potential, terminates in a plug of the design shown in FIGS. 3 and 4, having no neutral blades.

Figure 6:
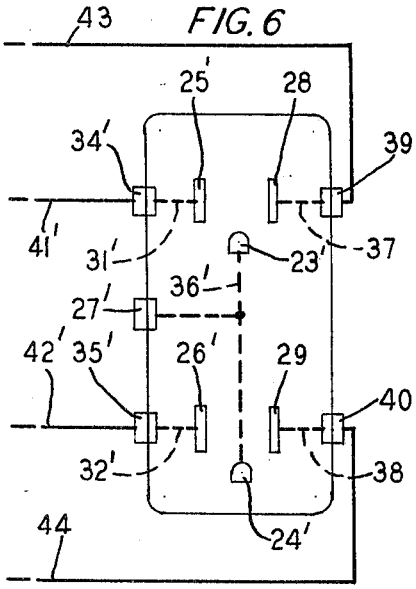
FIG. 6 is a plan view, partly in schematic, of a second embodiment of a plug or connector in accordance with the present invention.
Figure 7:
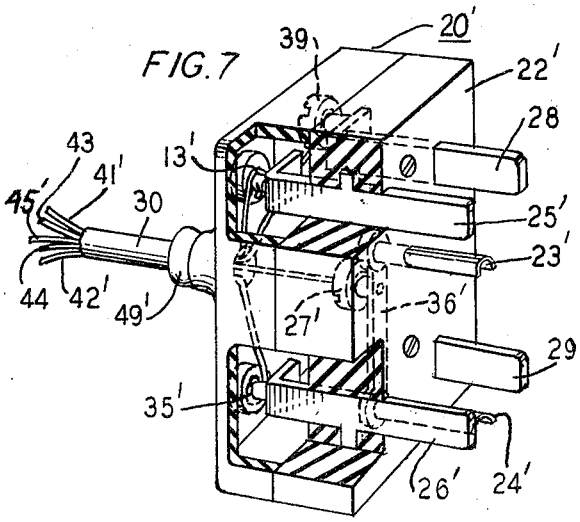
FIG. 7 is a perspective view, partially in schematic, of the second form of connector, as shown in FIG. 6, in which the housing has been partially broken away to reveal the internal construction.

FIGS. 6 and 7 depict a plug or connector in accordance with a modification of the present invention which provides the user with the option of connecting a single device across a potential which is equal to twice that of the line or house current, as in the embodiment depicted in FIGS. 3 and 4, or of simultaneously connecting each of a pair of devices across the unaltered line or house current potential which does not exceed about 125 volts across each receptacle, in the manner of two coventional plugs using the dual receptacle 1.

FIGS. 6 and 7 show two pairs of conductive power blades 25' and 26' and 28 and 29, respectively, and ground prongs 23', 24' projecting from the front surface 22' of the housing 20'. In this embodiment, the housing 20', power blades 25', 26' and ground prongs 23', 24' are substantially similar in material and construction to their like-numbered counterparts in the embodiment of FIGS. 3 and 4. The principal difference in the present plug or connector is the addition of a pair of neutral blades 28, 29. These are disposed with their major faces parallel to blades 25', 26' along a line parallel to and on the opposite side of the longitudinal centerline of the housing face 22'. Blades 28 and 29, which are respectively separated by about ½ inch from blades 25', 26', are identical in material and construction to the latter. The plug, including ground prongs 23', 24' and the two pairs of blades 25', 26' and 28, 29, is designed to engage standard duplex split wire receptacle 1 and the corresponding three pairs of female terminals found therein. It will be understood that in a modified embodiment, blades 25' and 26', 28 and 29, can be rotated through 90°, in which case they would be accommodated in an appropriately modified receptacle.

In the embodiment of FIGS. 6 and 7, all three pairs, including the power blades and ground prongs, extend through the front surface 22' and into the interior of the housing 20'. Within the latter, the inward extensions of power blades 25', 26', as in the previously described embodiment, are carefully insulated from one another and extend across the interior to contacting screws 34', 35' which are connected in mutually insulated relation to power leads 41', 42', which pass out through the nipple 49' and conduit 30', projecting from the rear surface of the housing 20'. In a similar manner, neutral blades 28, 29 are connected through their inward extensions comprising conducting means 37, 38, to screw connectors 39, 40. As shown in FIG. 7, these may be respectively connected to separately insulated lead wires 43 and 44 which lead out through nipple 49'. Within the interior of housing 20, the contact prongs 23', 24', which are designed to engage ground in the receptacle 1, are likewise electrically joined to each other by conducting member 36', which leads to ground screw contact 27', as in the previous embodiment. (See FIG. 6.) The ground conductor therefrom may be separately connected to ground or may be connected to a lead 45' which passes out through the nipple 49' projecting from the rear surface of the housing 20', together with the other lead wires. In the embodiment here described, the five insulated conductors 41', 42', 43, 44 and 45' may be grouped and enclosed within an insulative sleeve 30, thus forming the cord leading to an electrical appliance or other load source.

The designs for the embodiments of FIGS. 6, 7 and 8, 9 permit the user an option of having either a single voltage source of double the potential available at the receptacle, or, alternatively, two voltage sources each of which is equal to that of the ordinary line voltage across one-half of the receptacle. The double potential, up to 250 volts, is developed when the load source is connected across the two positive conductors 41', 42'. In the preferred embodiment of FIG. 8, the two neutral blades 28 and 29 are electrically strapped together by the conducting bar 33, having a contact member 22 which is connected to a single neutral lead 43'. The ground terminal 27' is connected through metallic lead wire 45' to the ground terminal of the appliance or load in the normal way.

Figure 8:
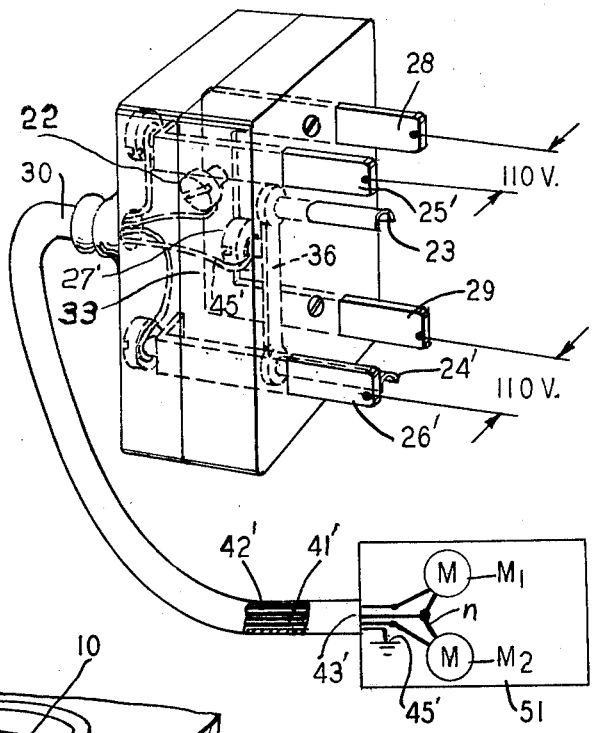
FIG. 8 is a perspective showing of a plug or connector of the embodiment of the invention disclosed in FIGS. 6 and 7, wired to provide power to a pair of motors requiring a potential not exceeding about 125 volts each.

FIG. 8 discloses a combination in which a circuit having unaltered line voltage normally provided across each half of the split wire receptacle is utilized for connection to a dual load appliance 51, which may, for example, comprise a pair of electrically isolated motors used to drive respirator equipment for a hospital patient, the extra motor providing a back-up which continues to operate if one motor fails. One of the hot wires 41', 42' is connected to each of the motors; and each motor is connected to neutral lead 43'. Metallic ground wire 45' is connected to an appropriate contact on either or both of the motors.

Figure 9:
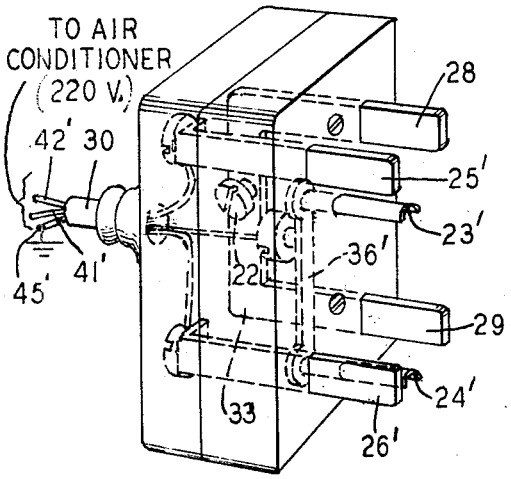
FIG. 9 is a perspective showing of a plug or connector in accordance with the embodiment of the invention disclosed in FIGS. 6 and 7, wired to service an air conditioner, requiring a potential not exceeding about 250 volts.

Alternatively, a plug of the type shown in FIGS. 6 and 7 may be connected across an air conditioner or other appliance requiring up to 250 volts, as shown in FIG. 9, in which case the two neutral contacts 28, 29 are strapped together internally by a conducting strap 33, which, in this case, has no external lead. In all of the embodiments disclosed, the high potential ground and neutral conductors may be color coded for ease of identification.

The present invention is not limited to the specific embodiments disclosed by way of example. It will be appreciated that plugs of each of the disclosed embodiments can be used with split wire direct current circuits, as well as the alternating current circuits shown herein. It will be understood that the scope of the invention is only limited as defined in the appended claims.

What is claimed is:

1. A unitary electrical connecting plug constructed to mate with a standard split wire duplex receptacle having two electrically isolated female slots respectively connected to high potential power terminals at substantially equal and opposite potential, two female neutral slots electrically connected together to a neutral terminal at a potential substantially halfway between the potentials of said high potential power terminals, and means comprising one or more slots for connection to ground potential, said plug comprising in combination:

an insulative housing having a rear wall including connecting means to an insulating conduit, side walls and a front wall opposite said rear wall, electrically conducting ground means rigidly disposed in said housing to extend outwardly in a substantially normal direction from the external face of said front wall and to extend inwardly to conducting means for making ground contact, and at least one pair of electrically conducting power blades insulated from each other and from said ground means, said pair rigidly disposed in said housing and extending outwardly in substantially normal direction from the face of said front wall and extending inwardly in said housing to separately insulated conducting means constructed for connection to a pair of electrically isolated high potential contacts, said power blades spaced apart on the external surface of said front face a distance which coincides with the spacing between said two electrically isolated high potential female slots of said split wire duplex receptacle, and constructed and arranged to engage said slots simultaneously as said ground means engages said means comprising a slot for connection to ground.

2. An electrical connecting plug in accordance with claim 1 constructed to mate with a standard split wire duplex receptacle wherein said electrically isolated female slots are each connected to high potential power terminals carrying alternating curent substantially 180° out-of-phase.

3. An electrical connecting plug in accordance with claim 1 constructed to mate with a standard split wire duplex receptacle wherein said electrically isolated female receptacles are each connected to high potential power terminals carrying direct current.

4. A plug in accordance with claim 1 wherein the means in said receptacle comprising one or more slots for connection to ground potential comprises one ground slot disposed in each half of said duplex receptacle, and said electrically conducting ground means rigidly diposed in said housing comprises a pair of ground prongs disposed to extend outwardly in a substantially normal direction from the external face of said front wall, said ground prongs in said plug electrically connected together and constructed to engage the corresponding ground slots in said receptacle simultaneously as the power blades of said one pair engage said electrically isolated high potential female slots.

5. A plug in accordance with claim 4 comprising a second pair of electrically conducting neutral blades connected together in electrically conducting relation, said blades spaced apart on the external surface of said front face a distance which coincides with the spacing between said female neutral slots of said split wire duplex receptacle and constructed and arranged to engage said slots simultaneously as the blades of said one pair engage said high potential female slots, and said ground prongs engage the ground slots thereof.

6. In combination with a plug in accordance with claim 4, an appliance requiring power at a potential substantially exceeding the potential to be derived across one high potential power slot and the corresponding neutral slot of said split wire duplex receptacle, said appliance having a high potential conductor, a low potential conductor and a ground conductor in mutually insulated relation in an insulating conduit, said conduit connected into said plug through said connecting means, said high and low potential conductors respectively connected across said one pair of electrically conducting high potential power blades of said plug, and said ground conductor connected through conducting means to the ground prongs of said plug.

7. A combination in accordance wih claim 6 wherein said appliance is constructed to require power of at least about 220 volts, and wherein the potential derived between one said high potential slot and the corresponding neutral slot on one side of said duplex receptacle does not exceed about 125 volts.

8. In combination with a plug in accordance with claim 5, an appliance requiring power at a potential substantially exceeding the potential to be derived across one high potential power slot and the corresponding neutral slot included in one outlet of said split wire duplex receptacle, said appliance having a high potential conductor, a low potential conductor and a ground conductor in an insulating conduit, said conduit connected into said plug through said connecting means, said high and low potential conductors respectively connected across said one pair of electrically conducting high potential power blades, said second pair of neutral power blades being electrically strapped together, and said ground conductor connected to said ground prongs.

9. The combination in accordance with claim 8 wherein said appliance is constructed to require power of at least about 220 volts, and wherein the potential derived between one high potential slot and the corresponding neutral slot included in one outlet of said duplex receptacle does not exceed about 125 volts.

10. The method of doubling the potential of electrical power derived by an appliance from a standard split wire duplex receptacle having two isolated female slots respectively disposed at opposite ends, said slots being respectively connected to high potential power terminals at substantially equal and opposite potentials, two corresponding female slots electrically connected together to a neutral terminal, and a pair of slots connected together for ground contact, which comprises the steps of:

simultaneously connecting the high and low potential terminals of said appliance between the said two electrically isolated high potential female slots of said receptacle, and simultaneously connecting the ground contact of said appliance into the ground slots of said receptacle.

* * * * *

UNITED STATES PATENT AND TRADEMARK OFFICE

CERTIFICATE OF CORRECTION

PATENT NO. : 4,019,797

DATED : April 26, 1977

INVENTOR(S) : Henry W. Praml

It is certified that error appears in the above-identified patent and that said Letters Patent are hereby corrected as shown below:

Column 2, line 25, after "connected" change "by" to --up--. Column 3, line 54, change "laod-bearing" to --load-bearing--. Column 4, line 14, change "2/16" to --1/16--. Column 5, line 8, change "identificatin" to --identification--; line 9, cancel "identification" and insert therefor --black--.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*